United States Patent [19]

Kessler

[11] Patent Number: 4,802,930

[45] Date of Patent: Feb. 7, 1989

[54] AIR-ANNEALING METHOD FOR THE PRODUCTION OF SEAMLESS TITANIUM ALLOY TUBING

[75] Inventor: Harold D. Kessler, Sun City West, Ariz.

[73] Assignee: Haynes International, Inc., Kokomo, Ind.

[21] Appl. No.: 111,600

[22] Filed: Oct. 23, 1987

[51] Int. Cl.[4] ..... C22F 1/18; C22C 14/00

[52] U.S. Cl. ..... 148/12.7 B; 148/11.5 F; 420/420

[58] Field of Search ..... 148/11.5 F, 12.7 B; 420/420

[56] References Cited

U.S. PATENT DOCUMENTS

| | | | |
|---|---|---|---|
| 3,795,970 | 3/1974 | Keathley et al. | 148/11.5 F |
| 3,969,155 | 7/1976 | McKeighen | 148/12.7 B |
| 4,053,330 | 10/1977 | Henricks et al. | 148/11.5 F |
| 4,098,623 | 7/1978 | Ibaraki et al. | 148/11.5 F |
| 4,581,077 | 4/1986 | Sakuyama et al. | 148/11.5 F |
| 4,600,449 | 7/1986 | White et al. | 148/12.7 B |
| 4,690,716 | 9/1987 | Sabol et al. | 148/11.5 F |

FOREIGN PATENT DOCUMENTS

| | | | |
|---|---|---|---|
| 1204359 | 9/1986 | Japan | 148/11.5 F |

*Primary Examiner*—Upendra Roy

*Attorney, Agent, or Firm*—Buchanan Ingersoll; Lynn J. Alstadt

[57] ABSTRACT

A process for the production of seamless titanium alloy tubing is disclosed in which solution annealing for all intermediate operations are performed in an air atmosphere furnace, followed either by water or room temperature air quench in order to achieve cooling within the requisite five (5) minutes. Preferably final aging is performed in a vacuum furnace to avoid surface contamination which would ordinarily require subsequent removal by pickling. This produced a finer grained product, which was more susceptible to defect detection by ultrasonic testing, which produced an optimum combination of strength and ductility, and which showed more uniform response to aging between different lots and tube sizes.

4 Claims, No Drawings

AIR-ANNEALING METHOD FOR THE PRODUCTION OF SEAMLESS TITANIUM ALLOY TUBING

BACKGROUND OF THE INVENTION

1. Field of the Invention

The present invention relates to an improved method for the manufacture of seamless tubing from a beta phase titanium alloy, so as to allow full solution treatment of the alloy tubing without the use of a vacuum furnace.

2. Description of the Prior Art

Titanium alloys have been available since the late 1950's, and the use of seamless tubing utilizing these alloys, most notably in the aerospace industry, began in the 1960's. The advantages in substituting titanium alloys for stainless steel, the metal used previously, are the savings in weight, an increased strength to weight ratio, and increased corrosion resistance.

Presently, titanium is utilized as an alloy to allow fine control of the metal's response to heat treatment. Heat treatment is used to reduce stresses developed during fabrication, to control strength or special properties, and to optimize ductility and structural stability.

A new alloy, Ti-15V-3Cr-3Sn-3Al, first developed in the 1970's, has been commercially available as cold rolled strip since the early 1980's This alloy is of the metastable beta phase type; it is "soft" and highly cold formable in the solution treated condition. The alloy can have a wide range of strength levels provided by aging from either the solution treated or cold worked conditions. It is weldable and highly corrosion resistant.

Seamless beta titanium alloy hydraulic tubing formed from this alloy is attractive to the aerospace industry because it can be heat treated to high strength levels by solution treating and aging or by solution treating, cold working and aging. Tubing utilizing this new alloy, however, has not been produced commercially to date largely because of problems with solution annealing between cold reductions and the final solution annealing operation. These processes are normally performed on titanium alloy tubing in a high vacuum furnace. The prior art has chosen vacuum annealing because there was a general belief that the use of atmospheric air furnaces would detrimentally affect the properties of the finished product. An oxide coating and diffusion layer forms during air annealing. These coatings reduce the mechanical properties of the coated metal.

The prior art does not provide a means for the formation of seamless beta phase titanium alloy tubing because of the inability of the currently available vacuum furnaces to accomodate commercial tube lengths. Full solution treatment of most beta alloys, which results in optimum properties after aging, requires that the product be cooled from the solution ambient temperature (1350 to 1550 F.) to 500 F. in less than approximately five (5) minutes, depending on the composition. This cannot be accomplished for the 8 to 20 foot tube lengths required by hydraulic tubing users in any currently available vacuum furnace, including furnaces using inert gas quenching systems.

Elemental titanium exists in two geometric forms. At temperatures under 1625 F. (885 C.), titanium has a close packed hexagonal structure, which is the alpha phase. At higher temperatures it converts to the beta phase, a body-centered cubic geometry. Alloying elements, or stabilizers, change the temperature at which the beta state becomes stable. In a beta alloy, such as that used here, exposure to selected elevated temperatures will decompose the beta structure to precipitate a fine dispersion of alpha phase, which increases strength.

During the tube manufacturing process, before and after hot or cold working, the metal undergoes several types of heat treatments, which require heating at specified temperatures for specific times, followed by cooling. The cooling in the case of solution treatment, must also occur within a specific time to confer the desired properties to the metal. These treatments are notably: stress relief annealing, solution treatment (sometimes called solution annealing), and aging. Additionally, contaminants and oxidation products must be removed after heat treatment.

Solution annealing serves to increase fracture toughness and ductility at room temperature. The intermediate solution annealing steps are performed before each successive pilger, or cold deformation, of the product. Solution treatment or solution treatment plus cold working (pilgering) and subsequent aging are used to increase the strength level of the metal. By heating to the solution treatment temperature, 1350 to 1550 F., and fast cooling, beta phase is stabilized to room temperature, and when subseqently aged at lower temperature, 800 to 1250 F., the beta phase decomposes into a stronger structure, due to a fine dispersion of alpha phase which increases the strength of the alloy.

After solution annealing, either water, air or furnace quenching can be utilized, but each would result in different tensile properties after aging. The rate of cooling from solution annealing temperatures is critical. If the process is too slow, then partial decomposition of the beta phase occurs during cooling, and the subsequent aging of the beta phase will not result in the desired strengthening effect; optimum ductility for subsequent pilgering is not achieved and aged properties of the final product are unpredictable and result in subnormal combinations of strength and ductility. Full solution treatment of the alloy requires that cooling take place within approximately five minutes, depending on the composition of the alloy. To avoid the formation of an oxide layer on the surface of the metal and a perceived detrimental effect on the final properties of the metal, the art teaches that cooling should be performed in a vacuum furnace. Unfortuately, no vacuum furnaces are available which will accomodate tubes over eight feet in length which are required by the aircraft industry. If the formation of an oxide layer is of no consequence, effective quenching can be achieved using available air heat treatment furnaces using air, water, brine or caustic soda solutions as needed to achieve the needed cooling rate. This is dependent on the cross sectional thickness and size of the tube.

The final steps in the process are aging and stress relief. Stress relief treatments decrease undesirable residual stresses from cold forming and straightening. This maintains shape stability without loss of yield strength. Aging consists of reheating to intermediate temperatures, causing partial decomposition of the beta phase to increase strength.

Prior to the present invention, there has been no solution to these problems. Consequently, beta titanium alloy tubing has not been made commercially.

SUMMARY OF THE INVENTION

I provide a method of producing metastable beta phase titanium alloy tubing by a series of pilgering steps followed by annealing. In order to circumvent the problems encountered with the vacuum furnace, solution annealing for all intermediate operations are performed in an air atmosphere furnace, followed either by water or room temperature air quenching in order to achieve cooling within five (5) minutes. During air annealing an oxide coating and an alpha phase oxygen diffusion layer forms on the tubing. After quenching, the tubes are descaled in a hot salt bath and pickled to remove the oxygen contaminated surface layer. After the final pilgering operation, I prefer to use direct aging in a vacuum furnace. By vacuum aging the pilgered product directly, contamination is avoided and the pickling process is minimized. This also produces a finer grained product, which is more susceptible to defect detection by ultrasonic testing, and which shows more uniform response to aging between different lots, heats and tube sizes.

DETAILED DESCRIPTION

In the improved process, all intermediate annealing operations are performed in an air atmosphere. My process begins when the initial material is steam cleaned and pilgered. The product is then degreased from the pilgering process and steam cleaned again. The first of the annealing steps is then performed in an air atmosphere. Quenching takes place, utilizing water or room temperature air as needed to cool within five minutes. After annealing, the metal is descaled in a hot salt bath and pickled in a nitric-hydroflouric acid solution to remove the oxygen contaminated surface layer. The product is then straightened, cleaned, and pilgered again. This process continues repeatedly until the desired diameter and thickness of tubing has been achieved. Once this specification has been achieved, the tubing is cleaned and final aged in a vacuum environment. This provides stress relief, and the aging required to decompose the beta phase to achieve desired properties. Normally, the final treatment would consist of solution treatment and then aging. This process uses direct aging in a vacuum furnace after pilgering to avoid the surface contamination that would occur if the final solution treatment were performed in air. It also removes hydrogen picked up during previous annealing and pickling operations. This results in a finer grained product, which is more susceptible to defect detection by ultrasonic testing, and which shows more uniform response to aging from lot to lot, heat to heat and between various tube sizes.

EXAMPLE

I have produced tubing from Ti-15V-3Cr-3Sn-3Al alloy. I began with a tube having an outside diameter of 3.40 inches with a wall thickness of 0.60 inches and a length of 7.1 feet. The tube was processed according to the following steps to produce tubing having an outside diameter of 0.375 inches, wall thickness of 0.028 inches, and final length of 887.1 feet.

1. The tube is steam cleaned.
2. The tube is pilgered to an outside diameter of 2.375, wall thickness of 0.330 and a length of 17.5 feet.
3. The tube is degreased, alkaline and steam cleaned.
4. The tube is annealed for 15 minutes at 1500 F. in an air atmosphere, then cooled.
5. The tube is descaled, pickled and straightened.

The tube is steam cleaned.

7. The tube is pilgered to an outside diameter of 1.50, wall thickness of 0.198, and a length of 44.3 feet.
8. The tube is degreased, alkaline and steam cleaned.
9. The tube is annealed for 10 minutes at 1500 F. in an air atmosphere, then cooled.
10. The tube is descaled, pickled and straightened.
11. The tube is steam cleaned.
12. The tube is pilgered to an outside diameter of 1.004, wall thickness of 0.100, and a length of 124.9 feet.
13. The tube is degreased, alkaline and steam cleaned.
14. The tube is annealed for 5 minutes at 1500 F. in an air atmosphere, then cooled.
15. The tube is descaled, pickled and straightened.
16. The tube is steam cleaned.
17. The tube is pilgered to an outside diameter of 0.629, a wall thickness of 0.055, and a length of 347.0 feet.
18. The tube is degreased, alkaline and steam cleaned.
19. The tube is annealed for 5 minutes at 1500 F. in an air atmosphere, then cooled.
20. The tube is descaled, pickled and straightened.
21. The tube is steam cleaned.
22. The tube is pilgered to an outside diameter of 0.379, wall thickness of 0.032, and a length of 968.3 feet.
23. The tube is degreased, soaped and rinsed.
24. The tube is flash pickled.
25. The tube is aged for 180 minutes at 1200 F. in a vacuum furnace.
26. The inside diameter is grit blasted to prepare surface for pickling
27. The outside diameter is lightly polished to prepare surface for pickling.
28. 0.002 inches are removed from the inside diameter by pickling.
29. 0.002 inches are removed from the outside diameter by pickling.

| | | |
|---|---|---|
| 30. | Final outside diameter: | .3750 inches. |
| | Final wall thickness: | .0280 inches. |
| | Final length: | 887.1 feet. |

31. The tube is ultrasonically and visually inspected and tested for strength and quality.

While I have described a present preferred embodiment of the invention, it is to be distinctly understood that the invention is not limited thereto but may be otherwise embodied and practiced within the scope of the following claims.

I claim:

1. In an improved process for forming metastable beta phase titanium alloy products of the type comprising a series of at least one intermediate cold forming step followed by an annealing step and wherein the alloy is rapidly cooled after annealing to achieve optimum physical properties wherein the improvement comprises air annealing the alloy during at least one of the series of intermediate cold forming and annealing steps.

2. The process of claim 1, further comprising the use of direct vacuum aging during a final annealing step;

3. The process of claim 1, wherein the beta titanium alloy products are tubing;

4. The process of claim 1, wherein the beta titanium alloy is Ti-15V-3Cr-3Sn-3Al.

* * * * *